United States Patent [19]

Audeh

[11] Patent Number: 5,062,976

[45] Date of Patent: Nov. 5, 1991

[54] PROCESS FOR PREPARING AN EXTREME PRESSURE LUBRICATING OIL ADDITIVE

[75] Inventor: Costandi A. Audeh, Princeton, N.J.

[73] Assignee: Mobil Oil Corporation, Fairfax, Va.

[21] Appl. No.: 545,003

[22] Filed: Jun. 28, 1990

[51] Int. Cl.[5] ..... C10M 143/06

[52] U.S. Cl. ..... 252/45; 72/42

[58] Field of Search ..... 252/45; 72/42

[56] References Cited

U.S. PATENT DOCUMENTS

| | | | |
|---|---|---|---|
| 3,471,404 | 10/1969 | Myers . | |
| 3,607,748 | 9/1971 | Wilson et al. . | |
| 3,697,499 | 10/1972 | Myers . | |
| 4,317,738 | 3/1982 | Spence . | |
| 4,344,854 | 8/1982 | Davis et al. . | |
| 4,584,113 | 4/1986 | Walsh . | |
| 4,645,610 | 2/1987 | Born et al. | 252/45 |
| 4,822,504 | 4/1989 | Audeh et al. . | |
| 4,904,402 | 2/1990 | Audeh . | |

*Primary Examiner*—Jacqueline V. Howard
*Assistant Examiner*—M. Nuzzolillo
*Attorney, Agent, or Firm*—Alexander J. McKillop; Charles J. Speciale; Michael J. Mlotkowski

[57] ABSTRACT

A process for preparing an oxidized sulfurized isobutylene product having utility as an EP additive. The process comprises the steps of: reacting sulfur monochloride with a stoichiometric excess of isobutylene; reacting the product so produced with an alkali metal monosulfide and free sulfur in an alcohol-water solvent; reacting the product so produced with an aqueous solution containing an alkali metal hydroxide; and reacting the liquid sulfurized isobutylene so produced with a mild oxidizing agent under conditions sufficient to effect the appearance of new infrared frequency bands at 1300 $cm^{-1}$ and 1030 $cm^{-1}$ indicative of the formation of sulfoxides and sulfones and recovering a liquid oxidized sulfurized isobutylene product which is soluble in a lubricating composition.

20 Claims, No Drawings

PROCESS FOR PREPARING AN EXTREME PRESSURE LUBRICATING OIL ADDITIVE

FIELD OF THE INVENTION

The present invention relates to the oxidation products of sulfurized olefins and, more particularly, to a process for the production of oxidation products of sulfurized isobutylene.

BACKGROUND OF THE INVENTION

In boundary lubrication, surface asperities often come in contact with each other even though the lubricant present between those surfaces serves to carry much of the existing load. Extreme pressure (EP) additives are a special class of boundary lubrication additives which chemically react with the metal surface to form compounds with lower shear strength than the metal. The resultant low-shear compound thus provides the requisite lubrication. EP oils are basically inhibited oils with added extreme pressure additives. The EP agent serves to control wear in the boundary lubrication phase; namely, starting stopping, shock loading and the like. If high points of mating surfaces come in contact during machine operation, the lower shear strength EP compound will shear, rather than fuse and cause scoring; thus, controlled wear is exchanged for destructive wear. EP additives find utility in greases, industrial oils and gear lubes.

Organic sulfur compounds have been known to have utility as additives for lubricating oils. These compounds provide extreme pressure properties to lubricants especially under high speed shock conditions. Unfortunately, the presence of sulfur in lubricating oils causes considerable corrosion of metals, particularly copper. Since lubricating oils often operate at relatively high temperatures, thermally unstable sulfur compounds may break down resulting in loss of the extreme pressure property and in increased metal corrosion. In U.S. Pat. No. 2,708,199, there is disclosed a method of producing organic polysulfides from olefins having from six to 30 carbon atoms resulting in polymers of the olefin containing two to three sulfur atoms per unsaturated bond of the olefin. However, without proper control of the reaction conditions, the resulting compound may be highly corrosive and unstable. Moreover, if olefins of less than six carbon atoms were used in this process, oil insoluble products would be obtained.

U.S. Pat. Nos. 3,471,404 and 3,697,499, the contents of which are incorporated by reference in their entirety, disclose stable oil-soluble organic sulfides having extreme pressure properties and low corrosiveness to metal. These patents teach that lubricating oil compositions containing an effective amount of the additives disclosed therein evidence good load carrying capability. Sulfurized isobutylene is one example of such an oil-soluble organic sulfides having extreme pressure properties.

U.S. Pat. No. 4,317,738 discloses that improved dispersants can be prepared by oxidizing an olefin and reacting the oxidized olefin with sulfur or a sulfur-yielding compound and an amine. The olefin can have a molecular weight of from about 150 to 140,000, but preferably ranges from about 300 to 100,000. The dispersants disclosed are said to have utility in lubricant compositions in amounts of about 0.1 to 10 percent based on the oil.

While sulfurized isobutylene has been found to be an effective EP additive, finding acceptance in formulations where such service is required, sulfurized isobutylene exhibits a specific low fatigue life, as measured by the well-known tapered roller bearing test. It would be desirable in many applications to use an EP additive which could exhibit an increase in fatigue life in the tapered roller bearing test.

Therefore what is needed is an EP additive which is both effective in extreme pressure applications and demonstrates an increase in fatigue life.

SUMMARY OF THE INVENTION

In accordance with the present invention, there is provided a process for preparing an oxidized sulfurized isobutylene product having utility as a an EP additive. The oxidative process is a mild oxidative process and consists of reacting sulfurized isobutylene in a suitable solvent carrier with hydrogen peroxide ($H_2O_2$). The process comprises the steps of: (a) reacting sulfur monochloride with from about 1 to 2 moles of isobutylene per mole of sulfur monochloride at a temperature of from about 20° C. to about 80° C.; (b) reacting the product produced in step (a) with an alkali metal monosulfide and free sulfur in a ratio of moles of alkali metal monosulfide to gram-atoms of free sulfur from about 1.8 to about 2.2:1; (c) reacting the product produced in step (b) with an aqueous solution containing from about 5 to about 20 percent of an alkali metal hydroxide for a time sufficient to reduce the chlorine content below about 0.5 percent; and (d) reacting the sulfurized isobutylene produced in step (c) with a mild oxidizing agent in a mole ratio of oxidizing agent to sulfurized isobutylene of between about 0.5 and about 2.5 moles of equivalent oxygen to 1 mole of sulfurized isobutylene at a reaction temperature between about 20° C. and about 95° C. under conditions sufficient to effect the appearance of new infrared frequency bands at 1300 $cm^{-1}$ and 1030 $cm^{-1}$ indicative of the formation of sulfoxides and sulfones and recovering a liquid oxidized sulfurized isobutylene product which is soluble in a lubricating composition. The resulting purified product imparts improved bearing life when incorporated into lubricant compositions.

It is therefore an object of the present invention to provide a process for the preparation of a reaction product having utility in lubricating compositions.

It is another object of the present invention to provide a process for the preparation of a reaction product which is an effective EP additive.

It is a further object of the present invention to provide a process for the preparation of a reaction product which imparts improved bearing life when incorporated into lubricant compositions.

It is yet another object of the present invention to provide a process for the preparation of an oxidized sulfurized isobutylene product having utility as a EP additive.

Other objects and the several advantages of the present invention will become apparent to those skilled in the art upon a reading of the specification and the claims appended thereto.

DETAILED DESCRIPTION OF THE INVENTION

While the sulfurized olefin to be mildly oxidized to form advantageous EP additives can be selected from a variety of commercially available materials, a particularly preferred material and a method for its preparation is described in detail in U.S. Pat. Nos. 3,471,404 and 3,697,499. As described therein, the olefin reactant to be used may contain from about two to about five carbon atoms. The preferred number of carbon atoms for the olefin ranges from three to about five. Such olefins as butylene, isobutylene or amylene and isoamylene may be used; in particular, the branched-chain olefins are the most preferred for use in the process of the present invention. Isobutylene is known to have greater reactivity to sulfur chloride than other olefins and yields highly stable reaction products. As such, isobutylene is particularly preferred.

To form the sulfurized olefin for subsequent mild oxidation, sulfur monochloride is first reacted with from 1 to 2 moles, and preferably from 1.25 to 1.8 moles, of the olefin per mole of the sulfur monochloride. The reaction is carried out by mixing the two reactants at a temperature from 20° C. to about 80° C. and preferably 30° C. to 50° C. The olefin is introduced into the liquid sulfur monochloride subsurface, at a rate commensurate with the absorption rate of the olefin into the sulfur monochloride. This reaction may take from a period of from 1 to 10 hours, although it is preferred that the reaction time be carried out as rapidly as possible.

The second step in the process for the production of the sulfurized olefin requires reacting the adduct of the first step with an alkali metal sulfide and free sulfur. In this reaction, the adduct is combined with a mixture of the alkali metal sulfide, preferably sodium sulfide, and sulfur. The mixture consists of up to about 2.2 moles of the metal sulfide per gram-atom of sulfur and preferably the ratio is 1.8 to 2.2. The mole ratio of alkali metal sulfide to adduct is about 0.8 to about 1.2 moles of metal sulfide per mole of adduct. These ratios are both considered significant in the practice of this invention as they have been found to contribute to the oil solubility and thermal stability of the final product. This reaction, furthermore, is carried out in the presence of an alcohol or an alcohol-water solvent under reflux conditions. The alcohol may be present in a concentration in the water of from 5% to 25% by weight. Water-soluble alcohols, such as methanol, ethanol, propanol, isopropanol, butanol, and the like, may be used. The reflux time ranges from 3 to 6 hours.

The third step in the process is the reaction between the sulfurized olefin, which contains from about 1 to about 3% of chlorine, with an inorganic base in a water solution. Alkali metal hydroxide may be used, particularly sodium hydroxide, at a concentration of about 5 to about 20% and preferably about 8 to 12%, by weight in water. The reaction must be continued until the chlorine content is below 0.5%. The concentration of the alkali metal hydroxide in water also appears to be of an important nature in the preparation of the sulfurized olefin and, therefore, the preferred range represents an effective concentration level. Higher concentrations may degrade the product severely and lead to reaction products which could not be separated from the reaction mass easily. The alkali metal hydroxide treatment of the sulfurized olefin is performed under reflux conditions for from 1 to 24 hours, although no more than 8 hours are usually sufficient. Other inorganic bases which may be used include alkali metal carbonates and ammonia. However, the alkali metal hydroxides, and particularly sodium hydroxide, produce the most desirable product a evidenced by the low degree of corrosiveness to copper metal.

The exact structure of the sulfurized olefin is not known. It may consist of monomers containing sulfur or monomers bridged in a cyclic structure by the sulfur. It is believed that about 75% or more of the product is made up of monomeric sulfides and the cyclic derivatives thereof. An important feature of these oil-soluble sulfurized olefins is that they contain from about 40 to about 60%, preferably 46 to 50%, sulfur in stabilized form, and less than 0.5% chlorine.

In the practice of the present invention, the mild oxidation of the sulfurized olefin is effected by mixing the sulfurized olefin, preferably sulfurized isobutylene in a suitable liquid organic carrier. As sulfurized isobutylene is particularly preferred, the remainder of this description will focus on the use of sulfurized isobutylene, although it is to be understood that the other sulfurized olefins previously described also find utility in the practice of the process of the present invention. Suitable liquid carrier agents include benzene, toluene, xylenes, and others which do not react with the oxidant. A mild oxidizing agent, preferably mixed with an aqueous solution of an acid, such as sulfuric acid, is then added to the sulfurized isobutylene solution and the mixture agitated sufficiently to insure contact between the peroxide and the sulfurized isobutylene. The resultant mixture is then allowed to settle into two separate phases and the liquid immiscible organic layer is removed and reserved for further treatment. The organic layer is then further treated with a reducing agent to remove any unreacted peroxide and can be further washed to remove traces of acid.

In preparing the oxidized sulfurized olefin of this invention, it is preferred to use a mole ratio of oxidizing agent of between 0.5 and 2.5 moles of equivalent oxygen to one mole of sulfurized isobutylene. Reaction temperature can be between about 20° C. and about 95° C.

Although hydrogen peroxide is preferred in the practice of this invention, other oxidants which can be used include permanganate, iodate, perborate and dichromate salts as well as per acids such as perchloric, permanganic, permonosulfuric and persulfuric acid and others, tertiary butyl hypochlorite, and acylnitrites.

The reaction between the oxidizing agent and the sulfurized isobutylene results in the appearance of new infrared frequency bands at 1300 $cm^{-1}$ and 1030 $cm^{-1}$ indicative of the formation of sulfoxides and sulfones as shown in the generalized reactions I and II below:

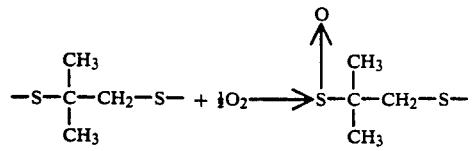

(I)

-continued

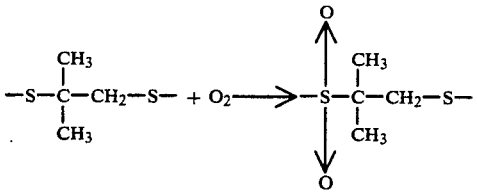

(II)

The additive products of this invention are used with lubricating oils or greases to the extent of from about 0.1% to about 10% by weight of the total composition. Furthermore, other additives, such as detergents, antioxidants, antiwear agents and the like may be present. These can include phenates, sulfonates, succinimides, zinc dialkyl dithiophosphates, polymers, calcium and magnesium salts of phenates and sulfonates, including overbased salts of the same, and the like.

The lubricants contemplated for use with the products herein disclosed include mineral and synthetic hydrocarbon oils of lubricating viscosity, mixtures of mineral oils and synthetic oils and greases from any of these, including the mixtures. The synthetic hydrocarbon oils include olefin polymers such as oligomers of hexene, octene, decene, and dodecene, etc. Other synthetic oils, which can be used alone with the compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the grease compositions of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in grease compositions are essentially hydrophobic clays. Such thickening agents can be prepared from clays which are initially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3 percent to 15 percent by weight of the total grease composition.

Having described the invention in general aspects, the following non-limiting examples are offered as specific illustrations.

EXAMPLES

In the following examples the rolling contact fatigue property of lubricants containing the oxidized sulfurized isobutylene of this invention are compared with that of compositions containing non-oxidized sulfurized butylene compositions. Lubricant fatigue properties are measured in terms of $L_{10}$ and $L_{50}$ of tapered roller bearings which is the length of time after which 10 percent or 50 percent respectively of a given number of bearings could be expected to fail by rolling contact fatigue.

EXAMPLE 1

This example describes the preparation of non-oxidized sulfurized isobutylene.

First, 202 grams of sulfur monochloride, boiling point =138° C., were heated with constant stirring from room temperature to 45° C. Then, 135 grams of the olefin 2-methyl propene, boiling point=−6° C., were added to the sulfur monochloride by sparging below the surface to yield 335 grams of product. Next, 215 grams of sodium sulfide nonahydrate were dissolved in 400 ml. of water. The 335 grams of product obtained above were then carefully added to the sodium sulfide nonahydrate solution such that the temperature of the reactants did not exceed 75° C.

After refluxing the reaction mixture so obtained for about 1 hour, the mixture separated into 2 layers—an aqueous layer, which was discarded, and an organic layer, which was treated with 10% aqueous NaOH to remove acidic components and components which react with a strong aqueous base. The purified material so produced was washed with water to remove excess alkali and had a final weight of 210 grams.

EXAMPLE 2

This example describes the process for the preparation of the oxidized sulfurized isobutylene of this invention. 136 grams of the sulfurized isobutylene were dissolved in 100 ml. of toluene. Ten (10) ml. of a 20-percent aqueous solution of sulfuric acid was added to 55 grams of a 30-percent aqueous solution of hydrogen peroxide. The acidified solution of $H_2O_2$ was then added dropwise with constant stirring at ambient room temperature to the solution of sulfurized isobutylene in toluene. The resulting mixture was heated to about 80° C. and allowed to react for a period of four hours. The mixture was allowed to cool to room temperature and to separate into an aqueous layer and an organic layer. The liquid organic layer was decanted and mixed with about 0.2 grams of manganese dioxide to destroy any unreacted peroxide entrained in the organic layer. This treated layer was then filtered and then washed with an aqueous solution or sodium bicarbonate and then with water alone. The product was then dried over magnesium sulfate and distilled to remove the toluene under vacuum at room temperature. This product when examined by infrared analysis exhibited two new absorption bands at 1300 $cm^{-1}$ and 1030 $cm^{-1}$ confirming the formation of sulfoxides and sulfones.

EXAMPLE 3

This example illustrates the properties of sulfurized isobutylene which has not been mildly oxidized in accordance with the process of the present invention. One-and-a-half grams of the sulfurized isobutylene prepared in Example 1, was added to 100 grams of a lube oil base stock having a viscosity of 464 centistokes at 40° C., a viscosity of 29.9 at 100° C. and a viscosity index of 93. This mixture wa then tested by the 4-ball weld test which measures the ability of the additive to withstand extreme pressure. In this test two results are reported; the first number measures the weld load and is reported in kilograms. The second number is a dimensionless one and is designated as the load wear index (LWI). The formulation in this example yielded the test results: 315 kg and 58.6 LWI, respectively.

EXAMPLE 4

This example illustrates the properties of the oxidized sulfurized butylene composition prepared in Example 2. In this example 1.5 grams of the material prepared in Example 2 were mixed with 100 grams of the same lube oil and then tested as in Example 3. Results were 315 kg. and and LWI of 58.3.

Examples 3 and 4 demonstrate that both formulations, Example 3 containing 1.5 percent of sulfurized isobutylene and Example 4 containing oxidized sulfurized isobutylene, have the ability to withstand extreme pressure. Those skilled in the art are aware of the specifications of 250 kg and 45 LWI by which EP additives are measured.

EXAMPLE 5

The following examples demonstrate the superiority of the oxidized sulfurized butylene compositions over the non-oxidized sulfurized butylene when tested on tapered roller bearings. In this Example 5 the lube oil base stock formulated with sulfurized isobutylene as in Example 3 was tested, yielding an $L_{10}$ of 291 hours and an $L_{50}$ of 564 hours.

EXAMPLE 6

The same base lube oil stock was formulated with the oxidized sulfurized isobutylene prepared in Example 2 and tested in the tapered roller bearing tester. Results of tests in the tapered roller bearing tester were: $L_{10}$ 405 hours and $L_{50}$ 898 hours. This example demonstrates that the oxidized sulfurized isobutylene extends the $L_{10}$ and $L_{50}$ lives of bearings when compared with the unoxidized sulfurized isobutylene of Example 1.

Examples 5 and 6 demonstrate that the change in the chemical nature of the sulfurized isobutylene as exhibited in the appearance of the IR bands at 1300 $cm^{-1}$ and 1030 $cm^{-1}$, yields superior performance as evidenced by the increased life of roller bearings.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the amended claims.

What is claimed is:

1. A process for making an extreme pressure lubricant additive comprising the steps of:

(a) reacting sulfur monochloride with from about 1 to 2 moles of isobutylene per mole of sulfur monochloride at a temperature of from about 20° C. to about 80° C.;

(b) reacting the product produced in step (a) with an alkali metal monosulfide and free sulfur in a ratio of moles of alkali metal monosulfide to gram-atoms of free sulfur from about 1.8 to about 2.2:1;

(c) reacting the product produced in step (b) with an aqueous solution containing from about 5 to about 20 percent of an alkali metal hydroxide for a time sufficient to reduce the chlorine content below about 0.5 percent; and (d) reacting the sulfurized isobutylene produced in step (c) with a mild oxidizing agent in a mole ratio of oxidizing agent to sulfurized isobutylene of between about 0.5 and about 2.5 moles of equivalent oxygen to 1 mole of sulfurized isobutylene at a reaction temperature between about 20° C. and about 95° C. under conditions sufficient to effect the appearance of new infrared frequency bands at 1300 $cm^{-1}$ and 1030 $cm^{-1}$ indicative of the formation of sulfoxides and sulfones and recovering a liquid oxidized sulfurized isobutylene product which is soluble in a lubricating composition.

2. The process of claim 1 wherein the mole ratio of isobutylene to sulfur monochloride is from about 1.25 to about 1.8:1.

3. The process of claim 1 wherein the sulfurized isobutylene produced in step (c) contains from about 4 to about 60 percent sulfur.

4. The process of claim 3 wherein the sulfurized isobutylene produced in step (c) contains from about 46 to about 50 percent sulfur.

5. The process of claim 1 wherein the sulfurized isobutylene is produced by reacting sulfur monochloride with from about 1.25 to about 1.8:1 moles of isobutylene per mole of sulfur monochloride, reacting the product of that reaction with an alkali metal monosulfide and 0.5 gram-atoms of free sulfur per mole of alkali metal monosulfide.

6. The process of claim 5 wherein the sulfurized isobutylene is dissolved in a carrier liquid selected from the group consisting of benzene, toluene, xylenes and others which do not react with the oxidizing agent.

7. The process of claim 6 wherein the oxidizing agent is an aqueous solution of a per acid selected from the group consisting of perchloric, permanganic, permonosulfuric and persulfuric acid.

8. The process of claim 1 wherein the alkali metal monosulfide is sodium hydroxide.

9. The process of claim 1 wherein the alkali metal monosulfide is sodium sulfide.

10. The process of claim 1 wherein the mole ratio of alkali metal monosulfide to the product produced in step (a) is from about 0.8 to about 1.0:2.

11. The process of claim 1 wherein the alkali metal monosulfide and sulfur are reacted with the product produced in step (a) in the presence of a water-soluble alcohol.

12. The process of claim 1 wherein the sulfurized isobutylene is dissolved in a carrier liquid selected from the group consisting of benzene, toluene, xylenes and others which do not react with the oxidizing agent.

13. The process of claim 1 wherein the oxidizing agent is an aqueous solution of hydrogen peroxide.

14. The process of claim 12 wherein the aqueous solution of hydrogen peroxide is acidified before being reacted with the sulfurized isobutylene.

15. The process of claim 1 wherein the recovered reaction product is purified by washing With water.

16. The process of claim 1 wherein the oxidizing agent is an aqueous solution of potassium or sodium permanganate.

17. The process of claim 1 wherein the oxidizing agent is an aqueous solution of potassium or sodium dichromate.

18. The process of claim 1 wherein the oxidizing agent is an aqueous solution of potassium or sodium iodate.

19. The process of claim 1 wherein the oxidizing agent is an aqueous solution of potassium or sodium perborate.

20. The process of claim 1 wherein the oxidizing agent is an aqueous solution of a per acid selected from the group consisting of perchloric, permanganic, permonosulfuric and persulfuric acid.

* * * * *

UNITED STATES PATENT AND TRADEMARK OFFICE

CERTIFICATE OF CORRECTION

PATENT NO. : 5,062,976

DATED : November 5, 1991

INVENTOR(S) : Costandi A. Audeh

It is certified that error appears in the above-identified patent and that said Letters Patent is hereby corrected as shown below:

Col. 8, Line 55, after "about" delete"4" add --40--

Signed and Sealed this

Second Day of March, 1993

*Attest:*

STEPHEN G. KUNIN

*Attesting Officer*

*Acting Commissioner of Patents and Trademarks*